US005154544A

United States Patent [19]

Arendt

[11] Patent Number: 5,154,544

[45] Date of Patent: Oct. 13, 1992

[54] SOCKET AND RATCHET HOLDER/ORGANIZER FOR TOOL BOX

[76] Inventor: Randall R. Arendt, 62949 New Haven Rd., New Haven, Mich. 48048

[21] Appl. No.: 751,501

[22] Filed: Aug. 29, 1991

[51] Int. Cl.[5] ..... B65D 85/20

[52] U.S. Cl. ..... 206/375; 206/378; 206/493

[58] Field of Search ..... 211/70.6; 206/376, 377, 206/378, 493, 564, 565, 373, 372, 375

[56] References Cited

U.S. PATENT DOCUMENTS

| | | | |
|---|---|---|---|
| 1,712,473 | 5/1929 | McWethy | 206/378 |
| 3,726,393 | 4/1973 | Thompson | 211/70.6 X |
| 4,043,453 | 8/1977 | Greenlee | 206/493 X |
| 4,380,293 | 4/1983 | Wilcox et al. | 206/378 X |
| 4,421,230 | 12/1983 | Stanton | 206/378 |
| 4,688,672 | 8/1987 | Pemberton | 206/378 |
| 4,865,194 | 9/1989 | Decarie | 206/378 |
| 4,927,020 | 5/1990 | Randy | 206/378 |
| 4,987,998 | 1/1991 | Tsai | 206/378 X |
| 5,071,004 | 12/1991 | Rivera | 206/376 X |

*Primary Examiner*—Paul T. Sewell
*Assistant Examiner*—Jacob K. Ackun, Jr.
*Attorney, Agent, or Firm*—David W. Schumaker

[57] ABSTRACT

A mechanics socket and ratchet organizing/storage device comprising of a base with a plurality of round cylindrical posts projecting upward from base. The posts are sized to accept the different socket drive sizes and arranged in a plurality of rows. Ratchet wrenches are also stored on device partially by resting the ratchet drive head on cone shaped towers, hollow at the center, sized to accept the ratchet drive square. The ratchet handles are held into position by a common rib in which the said handle rests on. Because of the varying heights of the rib, the ratchet handle resists undesirable movement.

6 Claims, 4 Drawing Sheets

SOCKET AND RATCHET HOLDER/ORGANIZER FOR TOOL BOX

BACKGROUND OF INVENTION

1. Field of the Invention

This invention relates to improvements on socket and ratchet tool organizers and holders for mechanics.

2. Prior Art

A problem a mechanic has when he acquires a professional size socket tool set is storage and organization necessary for normal and efficient use. There are other socket organizers and racks on the market today, but most are limited in size and feasibility.

The portable tray for mechanics sockets as disclosed in U.S. Pat. No. 4,353,465 hold sockets in place by a resilient metal finger which makes sockets difficult to remove especially when hands are greasy. The socket tray does hold an assortment of sockets, but not nearly enough for the professional mechanic. Also because of the design and materials used in construction, the cost is usually high.

The socket holders as disclosed in U.S. Pat. Nos. 4,337,860; 4,688,672; and 4,802,580 allow for easy removal and replacement of sockets on racks, but each holds a very limited amount of sockets, and the holders tend to move around or get knocked over in tool drawer, defeating its original purpose.

Another problem the mechanic faces when utilizing the socket tool holders as previously discussed, is that the devices make no accommodation for ratchets which are usually used in conjunction with the sockets. Because of this a mechanic may store the ratchet in another compartment of his tool box, costing him time and energy when he uses his socket tools.

Whatever the precise merits, features and advantages of the above cited references, none of them achieves of fulfills the purpose of the present invention.

SUMMARY OF THE INVENTION

The principal objective of the present invention is to provide a one piece device that will organize and store a greater supply of wrench sockets and ratchets and will fit into drawer of most roll-away tool chests.

Another objective is to provide for quick and easy removal and replacement of sockets onto organizer, maintaining that the sockets be resistant to becoming dislodged or falling over under normal usage.

It is also the objective of the present invention to provide accommodation for the ratchets usually associated with the sockets within the same storage unit.

A further objective is to provide such a device that is simple, one piece, and inexpensive to manufacture.

The foregoing objects can be accomplished by providing a socket and ratchet organizational device that in an illustrative embodiment is comprised of a flat planar base member, with a plurality of circular cylindrical nonresilient posts protruding upward and corresponding in diameter with the socket drive dimension sizes of the various sockets or crowfoot sets and arranged in a plurality of rows. The ratchets are held into place by means of a round protrusion extending upward from the planar base utilizing a round cylindrical hole, opening at the top of the protrusion, sized to accept the socket drive mechanism of said ratchet. The tail stocks of the three ratchets are held into position by a rib positioned laterally, extending upward from the planar base, with varying heights and peaks so as to resist tail stock from moving laterally in either direction.

These and other objects of the present invention will become apparent upon consideration of the following detailed description and accompanying drawings of the invention.

DETAILED DESCRIPTION

Figure 1:
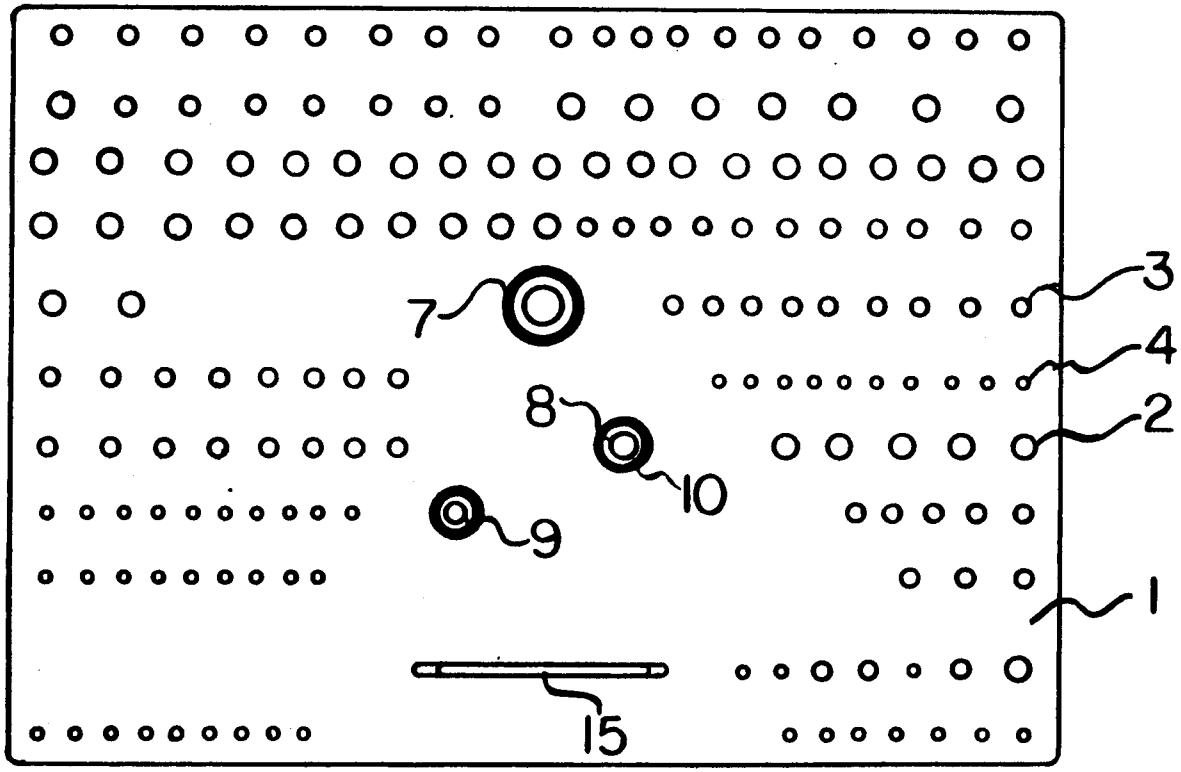
FIG. 1 is a plan view of the preferred embodiment of the Socket and Ratchet Holder.
Figure 2:
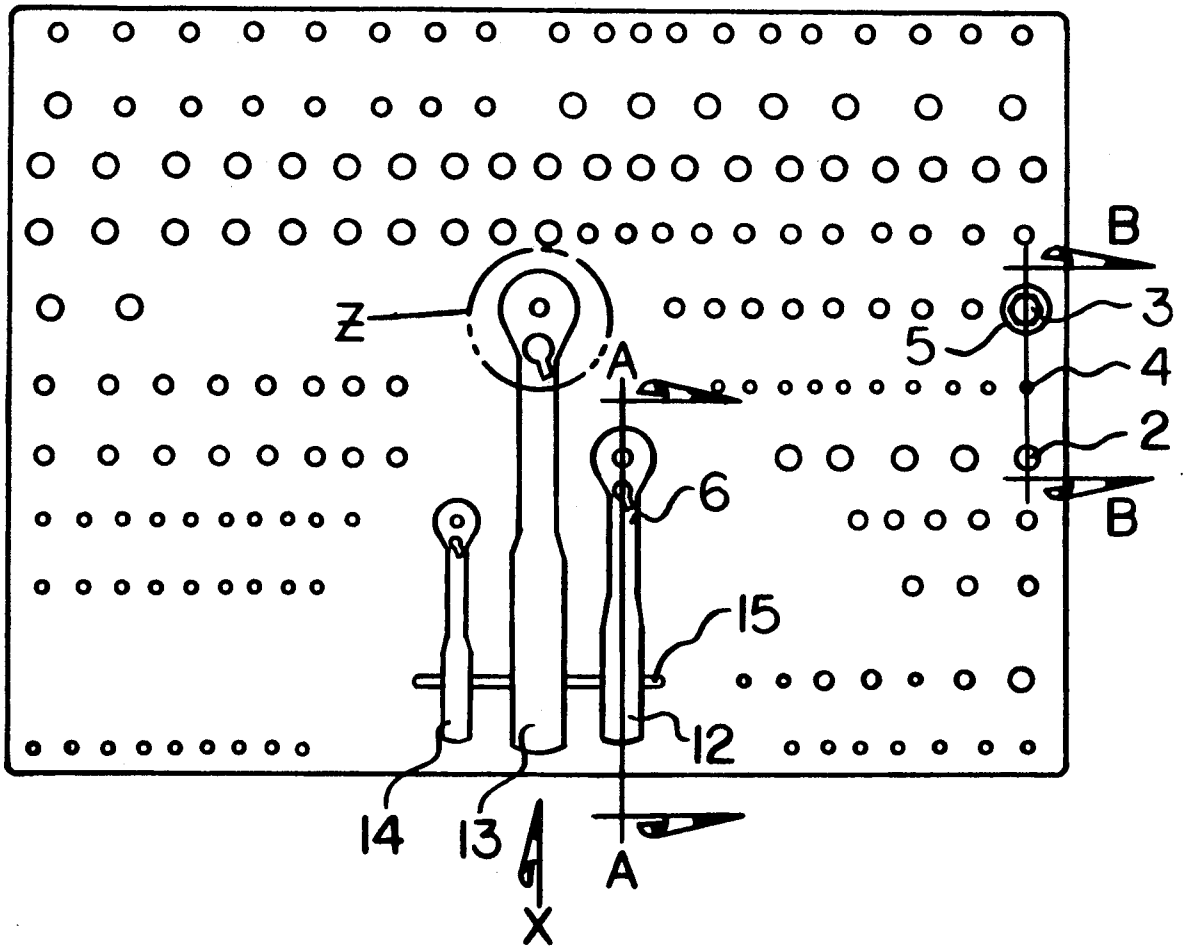
FIG. 2 is a plan view of the Socket and Ratchet Holder with three ratchets and one socket in place.
Figure 3:
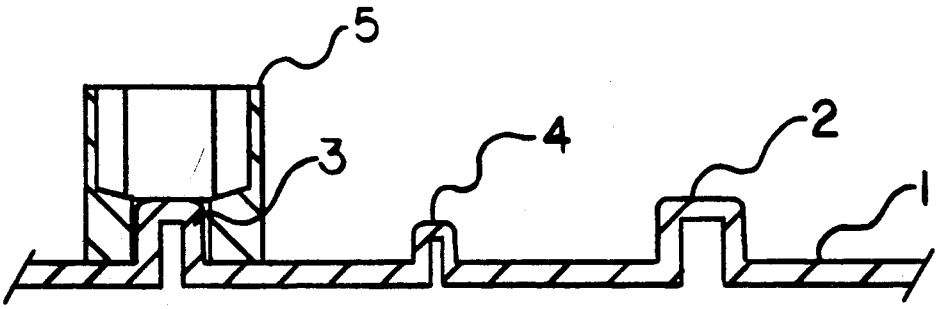
FIG. 3 is a fragmentary section of the posts and base with a socket in place as called out in FIG. 2.

Refer now to FIG. 1 which is an overall drawing of a preferred embodiment of the socket and ratchet tool holder/organizer. The device is molded of a durable plastic material. It is of a one piece design with outer dimensions measuring 22"×16½" so as to fit into a drawer of most roll-away tool boxes. The base 1 is a flat planar embodiment comprising of a plurality of circular cylindrical nonresilient posts 2, 3, 4 protruding upward. The outer diameter dimensions of the posts are ½, ⅜, and ¼ varying accordingly in size to accommodate the various sockets included in a set of sockets. As best seen in FIG. 3, the drive base of the socket 5 locates over the post and because the post diameter is slightly smaller than the socket drive square dimension, the socket is retained around the post with a slip fit. With the close tolerance between the post diameter and the socket drive square dimension, along with the distance that the post projects into the socket base, the socket is resistant to dislodging from the post. Because of the outer dimensions of the base 1 and the device being of a one piece design, the posts maintain a ridged entity and cannot fall over or move about in tool box.

The posts are arranged in a plurality of rows and are spaced to accommodate the various graduated sets of sockets.

Figure 4:
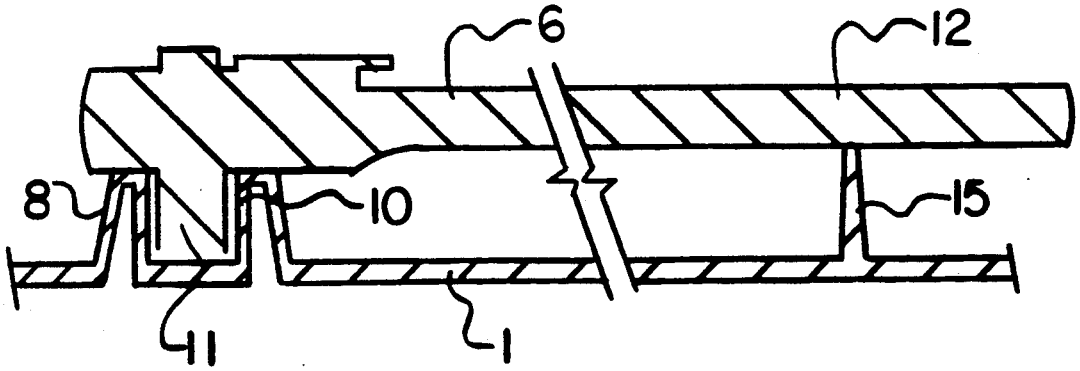
FIG. 4 is a fragmentary section with ratchet in place on holder as called out in FIG. 2.
Figure 5:
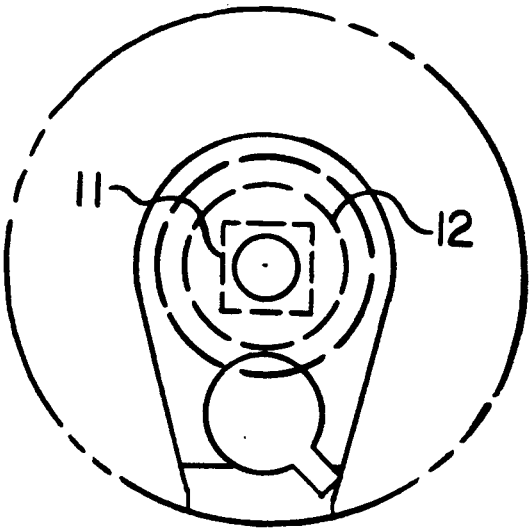
FIG. 5 is an enlarged view of ratchet head resting on holder.
Figure 6:
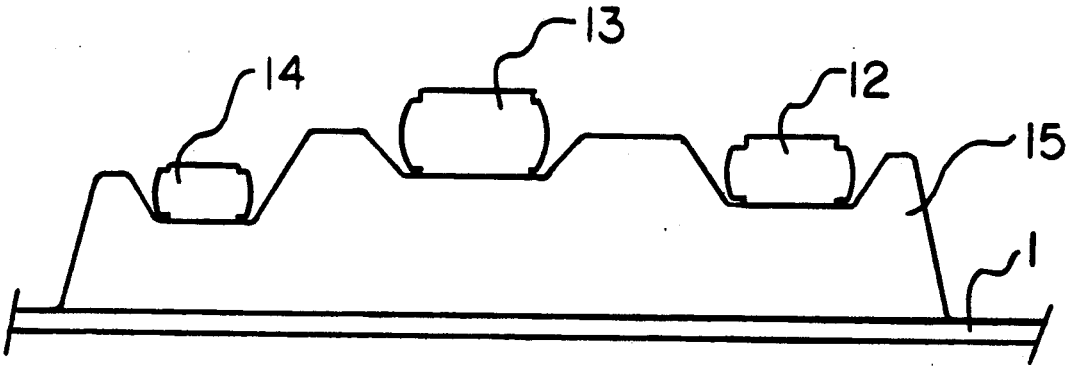
FIG. 6 is a fragmentary side view of base and rib with ratchet handles in place as shown in FIG. 2.

Ratchets 6 are held in position, as best seen in FIGS. 4 and 5, partly by conical shaped protrusions 7, 8, 9 extending upward from planar base 1, embodying a round cylindrical hole 10, open at the top of the protrusion, sized to accept the ratchet head drive square 11 of said ratchet. The diameter of the hole is larger than the corner to corner distance of the ratchet drive square allowing the ratchet drive head to rest on top of the protrusion with the drive square inserted in the hole, disallowing any appreciable movement. There are three ratchet head holders. One for ⅜ drive 8, one for ½ drive 7, and one for ¼ drive 9.

The ratchet handles 12, 13, 14 of the three ratchets are held into position by means of a common rib 15. The rib is positioned on the base perpendicular to the ratchet handles, and projects upward at a right angle to the base 1. The rib employs varying heights and peaks and is designed so the ratchet handle 12 will rest on the rib in its proper height and position, disallowing any appreciable lateral movement in either direction.

The unused space on the planar base 1 can be used for the installation of more posts if necessary for more sockets by gluing plastic round stock cutoffs of applicable dimensions to the base. The round stock could also be made of wood or metal and adhered to base by means of screws or other types of fasteners from the back side of the plastic base.

The outer dimension sizes of the base have been designed so the device will be accepted into drawer of most roll-away tool boxes. If a mechanic desired to utilize the socket organizer in a different size and type of tool chest, he could cut the base 1 of the organizer with a saw and custom fit the different portions of the organizer in drawers of his tool box.

A variety of socket tool sets can be accommodated with other versions of the socket tool organizer. One version would be to change the position and quantity of the socket posts for different socket sets. Also the outer base dimensions may be varied to accommodate different tool chests.

In summary the present invention has met the objectives that were stated previously. The present invention is a simple, one piece plastic device making it inexpensive to manufacture. Its size allows it to fit into a drawer of most roll-away tool boxes. The organizer holds a greater variety of sockets than those found on the market today and also makes accommodations for a set of ratchets too. The sockets and ratchets are easily removed and replaced on organizer providing quick and efficient use of socket tools.

The foregoing description of the preferred embodiment of the invention has been presented for the purposes of illustration and description. It is not intended to be exhaustive or limit the invention to the precise form disclosed. Many modifications and variations are possible in light of the above teachings. It is intended that the scope of the invention be limited not by this detailed description, but rather by the claims appended hereto.

What is claimed is:

1. A socket tool organizer and/or storage device comprising:

a. a single, flat, planar base, said base having an upper and a lower face;

b. a plurality of socket retaining projection means, for holding and sorting sockets, spacedly attached to the upper face of said planar base, said plurality of socket retaining projection means spacedly attached to said base so as to accommodate a wide variety of socket sizes, each of said plurality of socket retaining projection means consisting of a cylindrical protrusion fixedly attached to said base, said cylindrical protrusion being fixedly oriented such that the radial axes thereof are substantially parallel to the plane of said base, each of said plurality of socket retaining projection means having a diameter such that said socket retaining projection means engages the drive square opening of a socket in a snug but slip fit;

c. one or more drive head retaining projection means, for holding and sorting the drive heads of one or more socket ratchet drives, spacedly attached to the upper face of said planar base, said drive head retaining projection means consisting of a frusto-conical protrusion fixedly attached to said base, said frusto-conical protrusion being fixedly oriented such that the radial axes thereof are substantially parallel to the plane of said base, the base of said frusto-conical protrusion being adjacent to said upper face of said planar base, said frusto-conical protrusion including a centrally located, axially oriented, cylindrically shaped hollow portion extending therethrough, said cylindrically shaped hollow portion having a diameter such that said cylindrically shaped hollow portion engages the drive square of a drive head of a socket ratchet drive in a snug but slip fit;

d. a drive handle retaining projection means, for holding and sorting the drive handles of one or more socket ratchet drives, attached to the upper face of said planar base, said drive handel retaining projection means consisting of a planar protrusion fixedly attached to said planar base, said planar protrusion being fixedly oriented such that the plane of said planar protrusion is perpendicular to the plane of said planar base, the edge portion of said planar protrusion which is remote from said planar base having one or more indentations for retaining said drive handles of one or more socket ratchet drives, thereby resisting undesired lateral movement;

said one or more drive head retaining projection means and said drive handle retaining projection means being spacedly attached to said planar base so as to allow said one or more socket ratchet drives to engage individual drive head retaining projection means while engaging a common drive handle retaining projection means.

2. The socket tool organizer of claim 1 wherein said planar base, said plurality of socket retaining projection means, said one or more drive head retaining projection means, and said drive handle retaining projection means are fabricated as a one piece unit.

3. The socket tool organizer of claim 2 wherein said one piece unit is fabricated from a durable plastic material.

4. The socket tool organizer of claim 1 wherein said plurality of socket retaining projection means are disposed in a plurality of rows so as to accommodate graduated sets of sockets.

5. The socket tool organizer of claim 1 wherein each of said plurality of socket retaining projection means has the same diameter so as to accommodate a single socket drive size.

6. The socket tool organizer of claim 1 wherein each of said plurality of socket retaining projection means has a diameter selected from a plurality of diameters so as to accommodate a plurality of socket drive sizes.

* * * * *